US007341329B2

(12) United States Patent
Takagi

(10) Patent No.: US 7,341,329 B2
(45) Date of Patent: Mar. 11, 2008

(54) INKJET PRINTER

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 271 days.

(21) Appl. No.: 10/950,457

(22) Filed: Sep. 28, 2004

(65) Prior Publication Data

US 2005/0068366 A1 Mar. 31, 2005

(30) Foreign Application Priority Data

Sep. 29, 2003 (JP) ..... 2003-336595

(51) Int. Cl.
*B41J 2/165* (2006.01)

(52) U.S. Cl. ..... 347/33; 347/31

(58) Field of Classification Search ..... 347/22, 347/33, 29, 31, 42, 43, 49, 32, 45, 47; 216/27; 29/890.1
See application file for complete search history.

(56) References Cited

U.S. PATENT DOCUMENTS

| | | | | |
|---|---|---|---|---|
| 5,798,775 | A * | 8/1998 | Takahashi et al. | 347/33 |
| 6,578,945 | B2 | 6/2003 | Hashi et al. | |
| 6,672,697 | B2 * | 1/2004 | Haflinger | 347/12 |
| 2002/0044168 | A1 | 4/2002 | Hashi et al. | |

FOREIGN PATENT DOCUMENTS

| | | |
|---|---|---|
| EP | 0 494 693 A | 7/1992 |
| JP | A 3-136854 | 6/1991 |
| JP | A 4-37556 | 2/1992 |
| JP | A 10-95114 | 4/1998 |
| JP | A-11-207979 | 8/1999 |
| JP | A 2000-094714 | 4/2000 |
| JP | A 2002-120386 | 4/2002 |
| JP | A 2003-001855 | 1/2003 |
| JP | A 2003-1855 | 1/2003 |
| JP | A-2003-11358 | 1/2003 |
| JP | A-2003-170548 | 6/2003 |

OTHER PUBLICATIONS

U.S. Appl. No. 10/948,221, filed Sep. 24, 2004, Takagi.

* cited by examiner

*Primary Examiner*—Shih-Wen Hsieh
(74) *Attorney, Agent, or Firm*—Oliff & Berridge, PLC

(57) ABSTRACT

An inkjet printer includes a recording head, a spacer, a wiping member, and an inflow preventing member. The recording head includes an ejection surface in which a plurality of ejection ports for ejecting ink are defined. The ejection surface faces a medium transport path. The spacer is disposed in a periphery of the recording head and includes a facing surface, which faces the medium transport path. The wiping member wipes the ejection surface. The inflow preventing member prevents the ink from flowing into a gap between the recording head and the spacer.

24 Claims, 6 Drawing Sheets

INKJET PRINTER

BACKGROUND OF THE INVENTION

1. Field of the Invention

The present invention relates to a wiping technique of wiping away ink adhering to a recording head in an inkjet printer that ejects ink from nozzles of the recording head onto a printing medium to form an image.

2. Description of the Related Art

Inkjet printers that ejects small ink droplets from plural nozzles disposed in a recording head to conduct a printing operation are classified into a so-called serial head printer and a so-called line head printer. The serial head printers conduct a printing operation by a combination of a moving operation in a main scanning direction (the width direction of a sheet) in which ink is ejected while moving the recording head in the main scanning direction, and an operation in which the sheet is moved in a sub-scanning direction. The line head printers include a line head having a printing width that is equal to the width of a sheet functioning as a printing medium, and conduct a printing operation while relatively moving the line head and the sheet. In a line head printer, particularly, it is not required to move a recording head in the main scanning direction of a sheet. Hence, the printing speed can be made higher than that in a serial head printer.

In both the serial head printer and the line head printer according to the related art, in order to obtain an image of excellent quality, ink ejection from minute nozzles disposed in the recording head must be kept in satisfactory condition. Therefore, a wiping operation is conducted to wipe an ejection surface where ink ejection ports of the nozzles are disposed, thereby removing excess ink droplets or foreign matters adhering to the ejection surface.

The serial head printer described above has a structure in which the recording head can be moved in the main scanning direction. Therefore, a wiping operation can be conducted after the recording head is retracted to a region, which is on an extended line in the main scanning direction and is outside the printing region.

However, an ink jet head of the line head type has an ink ejection surface, which is larger than that of an ink jet head of the serial head type. When a printer is configured so that such a recording head is horizontally moved to a region outside the printing region and a wiping operation is then conducted, the size of the printer is inevitably increased. Therefore, in a line head inkjet printer according to the related art, a maintenance unit, which conducts a wiping operation, is inserted between the ink jet head and a medium transporting apparatus while a recording head is kept to be horizontally fixed, and a wiping operation is then conducted.

JP-A-2003-1855 (pages 10-12; and FIG. 20) discloses a line head inkjet printer in which ink absorbing members are disposed between plural recording heads, so that after an ejection surface of one of the recording heads is wiped, ink adhering to a wiper is prevented from adhering to another recording head to be next wiped by the wiper, thereby eliminating color mixture.

SUMMARY OF THE INVENTION

In the related art, ink, which adheres to a wiper during a wiping operation, is wiped away by the ink absorbing members. However, there is the possibility that part of the ink adhering to the wiper may flow into the periphery of the recording head during the wiping operation, and thus remains in the periphery of the recording head. The ink remaining in the periphery of the recording head causes problems in that it drips on a transporting apparatus or a sheet, and that it flows from a portion where the recording head is mounted to the interior of the recording head.

It is an object of the invention to provide an inkjet printer, which can solve the above-discussed problems and in which ink adhering to a wiper during a wiping operation can be adequately removed away without causing the ink to remain in the periphery of a recording head, whereby a recording sheet and a transporting apparatus can be prevented from being contaminated. Accordingly, the printing quality can be maintained to excellent condition.

In order to solve the problems, according to one embodiment of the invention, an inkjet printer includes a recording head, a spacer, a wiping member, and an inflow preventing member. The recording head includes an ejection surface in which a plurality of ejection ports for ejecting ink are defined. The ejection surface faces a medium transport path. The spacer is disposed in a periphery of the recording head and includes a facing surface, which faces the medium transport path. The wiping member wipes the ejection surface. The inflow preventing member prevents the ink from flowing into a gap between the recording head and the spacer.

According to one of the invention, during a wiping operation, an ink can be prevented from entering the periphery of a recording head to remain therein, a situation where a remaining ink drips on a transporting apparatus or a sheet to contaminate it, or an ink enters the interior of the recording head to cause a failure can be prevented from occurring, and the printing quality can be maintained to excellent condition.

DETAILED DESCRIPTION OF THE PREFERRED EMBODIMENT

Embodiment 1

Hereinafter, an embodiment of the invention will be described with reference to the accompanying drawings.

Figure 1:
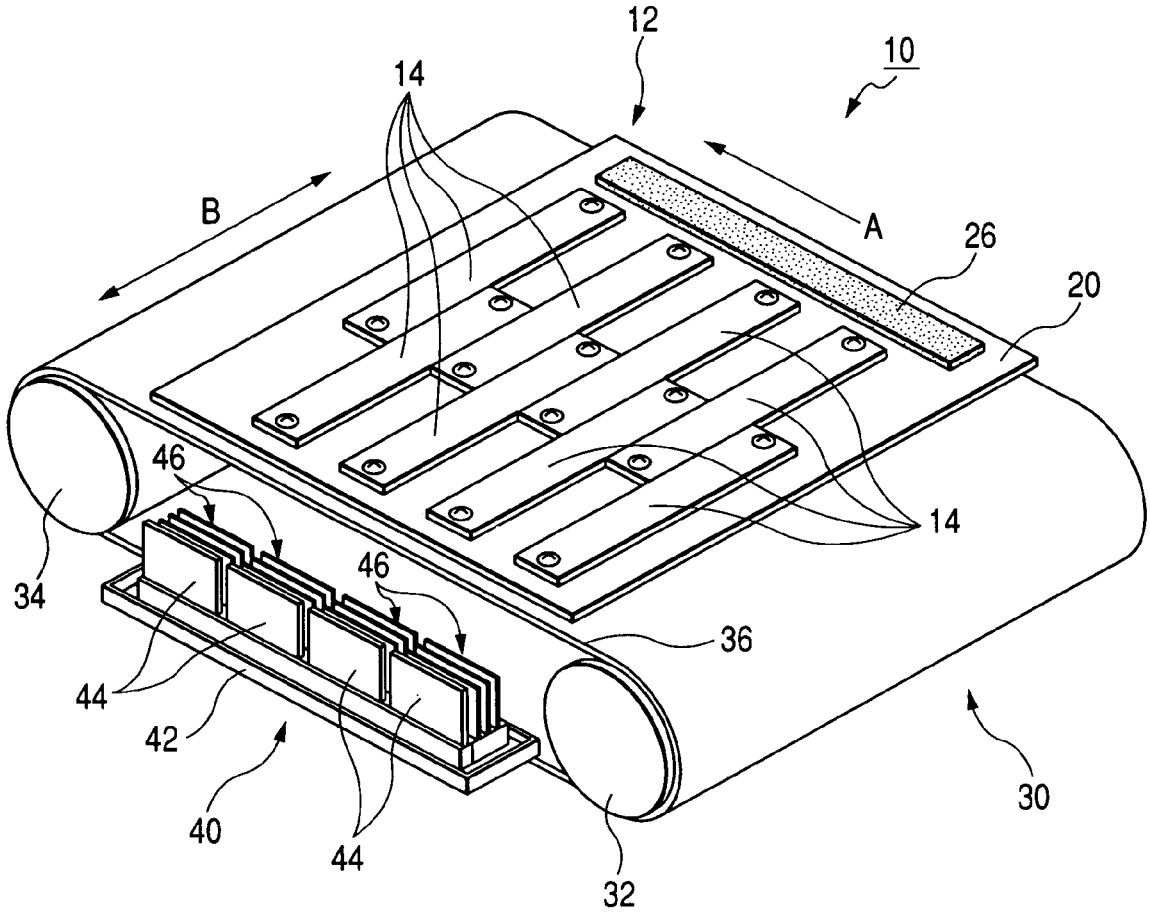
FIG. 1 is a perspective view schematically showing main portions of an inkjet printer 10.

First, main portions of an inkjet printer of the embodiment 1 of the invention will be described with reference to FIG. 1. FIG. 1 is a perspective view schematically showing the main portions of the inkjet printer 10 of the embodiment 1.

The inkjet printer 10 shown in FIG. 1 is a color inkjet printer of the line head type having eight line-type recording heads 14 as an image forming portion 12. Namely, the printer 10 is a line-printing type inkjet printer in which, during a printing operation, the recording heads 14 are positionally fixed and form an image on a sheet transported by a transport unit 30.

Each of the recording heads 14 has a flow path unit in which ink flow paths each including a pressure chamber are formed; and an actuator unit, which pressurizes ink in each of the pressure chambers. Many ejection ports 18 (see FIG. 3) of a small diameter corresponding to nozzles are disposed in rows in a bottom surface (ejection surface 16) of each recording head 14, so that when the actuator unit is driven, ink is ejected without forming gaps in the sheet width direction. Among the eight recording heads 14, four heads are attached to each of two head holders 20 so as to be arranged in a medium transporting direction (a direction of the arrow A in FIG. 1) as viewed in a direction (a direction of the arrow B in FIG. 1, and hereinafter referred to as the width direction) perpendicular to the medium transporting direction. The inkjet printer 10 is configured so that a printing operation for one line of one of four colors (yellow (Y), magenta (M), cyan (C), and black (K)) in the width direction of a sheet is conducted by using two of the recording heads 14. Specifically, the eight recording heads 14 are divided into four groups in each of which inks of the same color are to be ejected, and the recording heads 14 of the same group are fixed so as to partly overlap with each other as viewed in the medium transporting direction.

The recording heads 14 are placed so that a small gap is defined between their ejection surfaces 16 and a transport belt 36, and a medium transport path is formed in the gap. According to the configuration, when a sheet transported on the transport belt 36 is sequentially passed immediately below the eight recording heads 14, the color inks are ejected from the ejection ports 18 toward an upper face (printing face) of the sheet, whereby a desired color image is formed on the sheet. In the inkjet printer 10, the transport unit 30 transports a sheet supplied from a sheet supply unit (not shown) so that the sheet passes below the recording heads 14, is subjected to an image forming process, and then discharged to a sheet discharge unit (not shown).

The transport unit 30 has two belt rollers 32, 34, and the transport belt 36 wound around the belt rollers 32, 34. The belt roller 32 is a driving roller to which a driving force is transmitted from a transport motor (not shown) to be rotated. By contrast, the belt roller 34 is a driven roller rotated by a rotational force of the transport belt 36 that is provided by the rotation of the belt roller 32.

The transport belt 36 is an endless belt, which is made of a flexible material such as rubber and is formed into a loop-like shape. In the transport belt 36, the outer peripheral face is treated with silicon rubber so that a transported sheet can be transported by the driving of the belt roller 32 in the medium transporting direction while the sheet is held onto the outer peripheral face by adherence.

The inkjet printer 10 includes a maintenance unit 40 which conduct a restoring operation to maintain the ink ejection through the minute ejection ports 18 disposed in the recording heads 14 to satisfactory condition. The restoring operation is conducted at a timing such as that when an ink is initially introduced from an ink source (not shown) to one of the recording heads 14, or that when the printer 10 has not been used for a long term and the operation of the printer is then resumed. In the embodiment 1, a wiping operation of wiping away ink adhering to the ejection surfaces 16 is conducted. In addition, a purging operation of suction- (or pressure-) removing ink inside the recording heads 14 through the ejection ports 18 may be conducted. Also, when the printing operation is not conducted, a capping operation of setting the ejection surfaces 16 to a hermetically closed state may be conducted in order to prevent ink in the vicinities of the ejection ports 18 from drying.

As shown in FIG. 1, the maintenance unit 40 includes a frame 42, four wipers 44, and comb-like members 46. The maintenance unit 40 can be moved in the width direction by a moving mechanism not shown.

The wipers 44 are attached to the frame 42*a* in accordance with the recording heads of the respective colors. The comb-like members 46 are attached on a front side (the transport unit 30 side). The wipers 44 are members for wiping away ink remaining on the ejection surfaces 16 of the recording heads 14, and made of polyurethane rubber having an ink resistance. The comb-like members 46 have a structure in which plural slender plates erect parallel to the medium transporting direction, and a small gap is formed between the plates. The levels of the upper ends of the comb-like members 46*a* are adjusted so that the upper ends can pass a position separated from the respective ejection surfaces 16 by a small distance. Among ink droplets adhering to the ejection surfaces 16, therefore, those of a relatively large size make contact with the comb-like members 46 to be transferred to the comb-like members 46, and hence are removed away from the ejection surfaces 16. The removed ink is sucked into the gaps between the plates by capillary action to be held therein.

In order to conduct the wiping operation, the inkjet printer 10 includes a mechanism (not shown) for vertically moving the transport unit 30 so as to form a space, which enables the maintenance unit 40 to be inserted into a position where the maintenance unit 40 faces the ejection surfaces 16. During a printing operation and the like, the maintenance unit 40 waits at a position which is separated from the transport unit 30 in the width direction. During the wiping operation, the transport unit 30 is downward moved, and the maintenance unit 40 is then moved in the width direction to apply the wiping operation on the ejection surfaces 16. The mechanism for moving the transport unit 30 and the maintenance unit 40 is realized by a known technique such as JP-A-2002-120386, which is incorporated herein by reference in its entirety. Hence, its detailed description is omitted.

Figure 2:
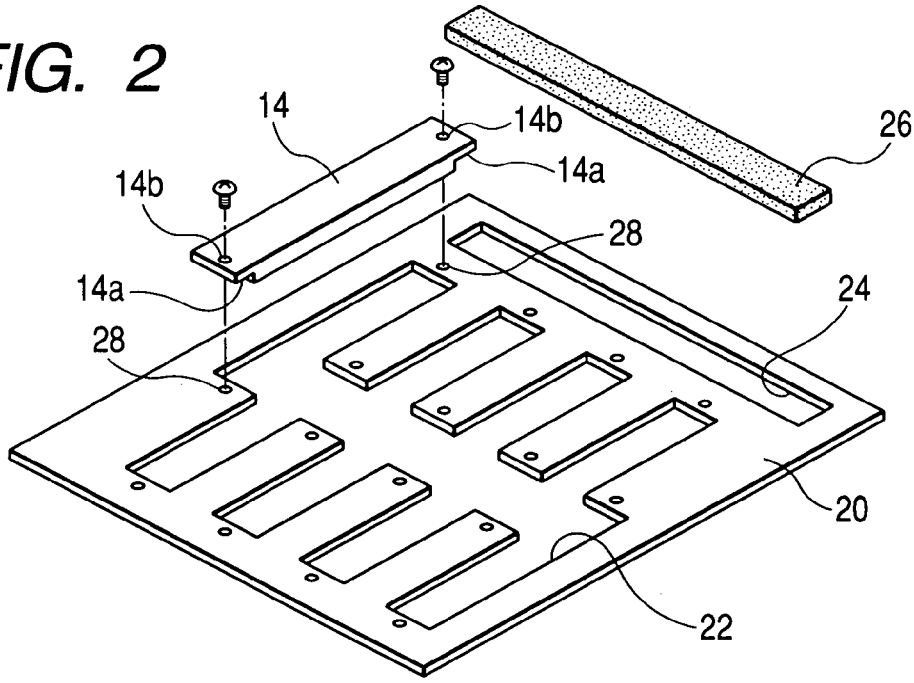
FIG. 2 is a perspective view showing the appearance of head holders 20.

Next, the image forming portion 12 of the inkjet printer 10 will be described with reference to FIGS. 2 to 4. FIG. 2 is a perspective view showing the appearance of the head holder 20.

In each of the recording heads 14, as shown in FIG. 2, holding portions 14*a* and screw holes 14*b* for attaching the recording head 14 to one of the head holders 20 are provided at both ends thereof in the longitudinal direction, respectively.

The head holder 20 is a member which is used for fixing the eight recording heads 14, and formed of an aluminum plate in which an opening 22 into which the recording heads 14 are to be fitted is defined. A face (facing surface) of the head holder 20 facing the medium transport path is designed so as to be positioned in the same level (the same plane; the same height) as the ejection surfaces 16 of the recording heads 14 (see FIG. 4). Thus, the head holder 20 functions as a spacer for preventing sheet jamming from occurring due to a phenomenon that the tip end of a sheet enters between the recording heads 14. In the embodiment 1, the recording heads 14 are placed so that they are partly close to one another, and hence the recording heads 14 are fitted into the single exposure opening 22. Alternatively, an exposure opening may be independently formed for each of the recording heads 14.

In the head holder 20, a placement hole 24 where an ink absorbing member 26 (functioning as a second ink absorbing member), which absorbs ink adhering to the wipers 44 during the wiping operation, is to be placed is defined. The ink absorbing member 26 is fittingly fixed to the placement hole 24 in such a manner that the lower face of the ink absorbing member 26 slightly protrudes from the facing surface of the head holder 20.

In the head holder 20, screw holes 28 for fixing the recording heads 14 are defined in the periphery of the exposure opening 22. The recording heads 14 are fixed by screws while the screw holes 14*b* of the holding portions 14*a* are positionally aligned with the screw holes 28 of the head holder 20. At this time, a small gap is formed between surfaces of the recording heads 14 adjacent to the ejection surfaces 16, and the head holder 20. When the wipers 44 wipe the ejection surfaces 16, ink may flow into the gaps to remain therein. Consequently, there is the possibility that the remaining ink may drop on the transport belt 36 or a sheet to contaminate it. However, a technique, which will be described below, prevents ink from flowing into the gaps.

Figure 3:
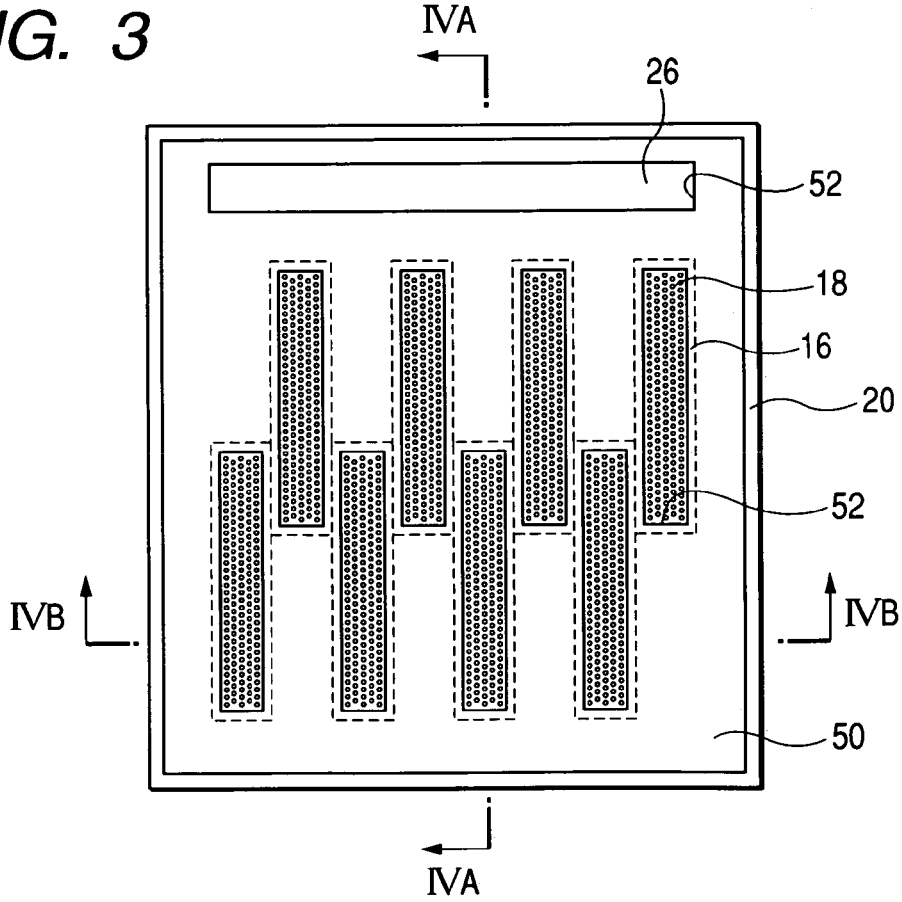
FIG. 3 is a view showing a state where recording heads 14 are attached to the head holder 20, as looking from the side of ejection surfaces 16.

FIG. 3 is a view showing a state where the recording heads 14 are attached to the head holder 20 when viewed from the side of the ejection surfaces 16. In the state where the recording heads 14 are attached to the head holder 20, as shown in FIG. 3, a water repellent sheet 50 (functioning as an inflow preventing member), which repels ink is stretched on the facing surface of the head holder 20 and the ejection surfaces 16, and bonded to the facing surface and the ejection surfaces 16. The sheet 50 has openings 52 corresponding to the ejection ports 18 of the recording heads 14 and the ink absorbing member 26, and closes the gaps between the ejection surfaces 16 and the head holder 20 while exposing the ejection ports 18 and the ink absorbing member 26 to the medium transport path.

Figure 4A:
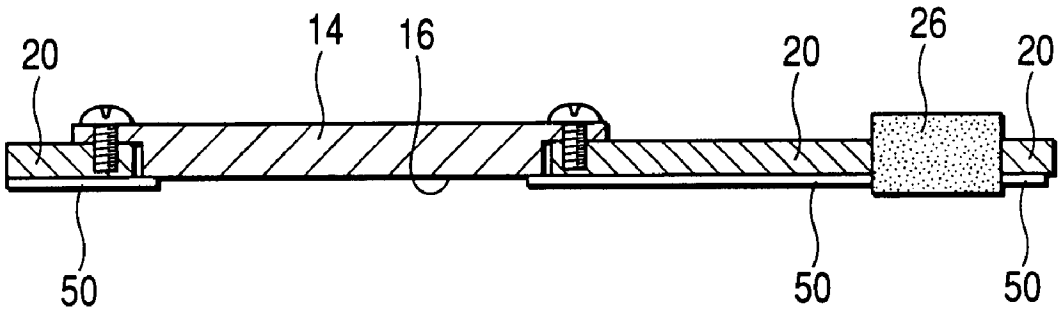
FIG. 4A shows a section view taken along the line IVA-IVA in FIG. 3.
Figure 4B:
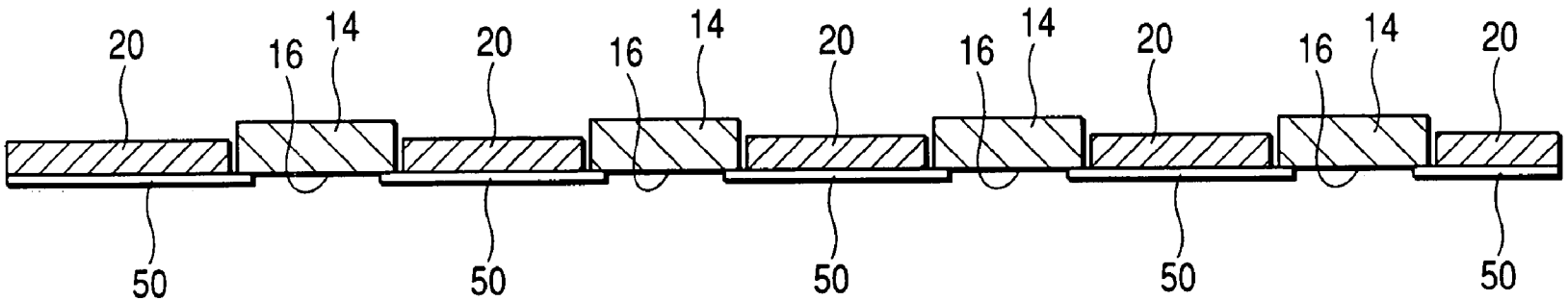
FIG. 4B shows a section view taken along the line IVB-IVB.

FIG. 4A shows a section view taken along the line IVA-IVA in FIG. 3. FIG. 4B shows a section view taken along the line IVB-IVB. In the inkjet printer 10, as shown in FIGS. 4A and 4B, the gaps between the recording heads 14 and the head holder 20 are closed by the sheet 50. Hence, it is possible to prevent a phenomenon from occurring that ink remains the gaps to drip during the wiping operation.

In the configuration where the gaps between the ejection surfaces 16 and the head holder 20 are closed by the sheet 50, when the ejection surfaces 16 are different in level from the facing surface of the head holder 20, steps are formed in the sheet 50. Hence, there is the possibility that ink cannot be adequately wiped away in the wiping operation. In the embodiment 1, therefore, the ejection surfaces 16 and the facing surface of the head holder 20 are designed so as to be in the same level, or to form steps therebetween, which are so small in degree that ink does not remain as a result of the wiping operation.

In the embodiment 1, since the sheet 50 having water repellency is used, the effect of preventing ink from remaining on the sheet 50 is higher than that in the case where a sheet not having water repellency is used.

Figure 5A:
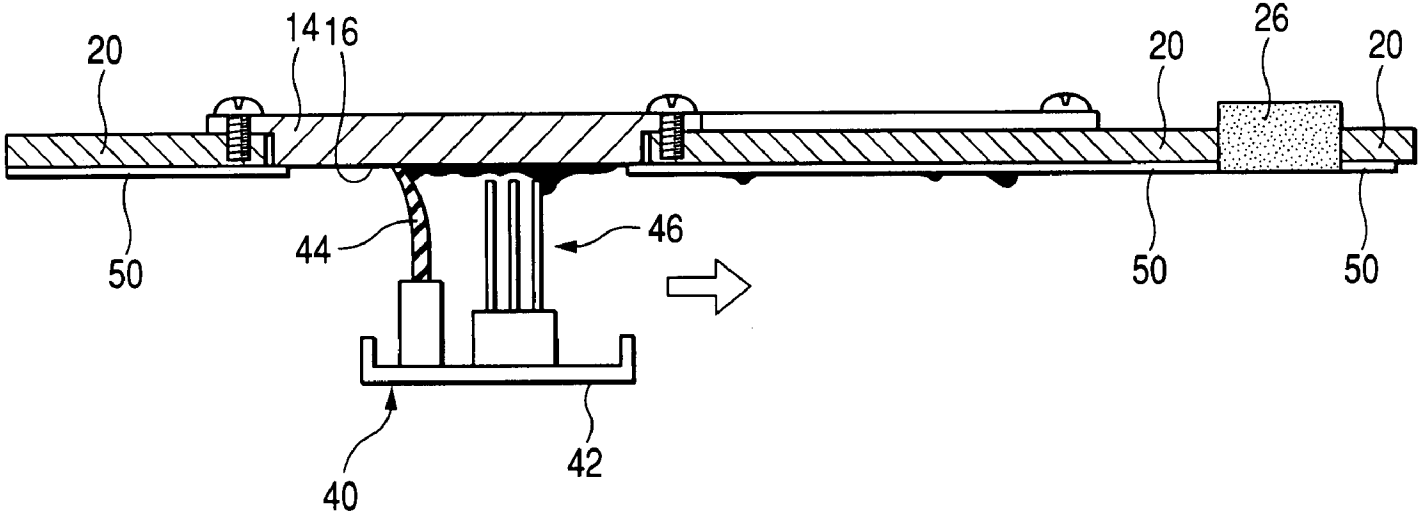
FIGS. 5A and 5B are views illustrating a wiping operation.
Figure 5B:
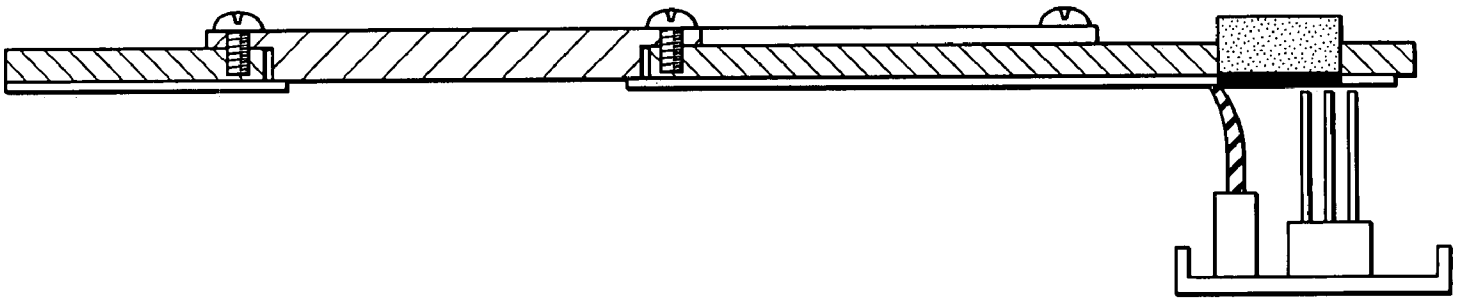

Next, the wiping operation of the thus configured inkjet printer 10 will be described with reference to FIGS. 5A and 5B. FIGS. 5A and 5B are views illustrating the wiping operation.

In the wiping operation, the transport unit 30 is moved so as to be separated from the ejection surfaces 16, thereby forming a space into which the maintenance unit 40 is to be inserted. The maintenance unit 40 in which the wipers 44 and the comb-like members 46 are disposed is moved toward the ejection surfaces 16 in the width direction (the direction of the arrow B in FIG. 1).

As shown in FIG. 5A, first, large ink droplets among inks adhering to the ejection surfaces 16 are removed away by the comb-like members 46, and the inks still adhering to the ejection surfaces are wiped away by the wipers 44. At this time, the gaps between the recording heads 14 and the head holder 20 are closed by the sheet 50. Hence, a phenomenon that ink adhering to the wipers 44 flows into the gaps and remains therein does not occur.

As shown in FIG. 5B, the ink adhering to the wipers 44 is finally absorbed by the ink absorbing member 26. The ink, which drops down along the wipers 44 and the comb-like members 46 to accumulate on the frame 42 of the maintenance unit 40, is discharged through a tube not shown into the waste ink reservoir.

Although a preferred embodiment of the invention has been described above, the invention can be adequately modified within the technical scope set forth in claims.

In the embodiment 1, for example, the sheet 50 is bonded so as to cover the whole facing surface of the head holder 20. When a water repellent process is applied to the facing surface of the head holder 20, however, it is not always required to bond the sheet 50 so as to cover the whole facing surface. The sheet 50 is requested to be bonded only to a region where the gaps between the recording heads 14 and the head holder 20 can be closed, for example, only in peripheral edge portions of the facing surface, which are in close proximity to the recording heads 14.

In the embodiment 1, the sheet 50 is disposed in the whole range of the gaps between the recording heads 14 and the head holder 20. Alternatively, the sheet 50 may be disposed at least on the downstream side of the recording heads 14 in the wiping direction of the wipers 44. This is because the ink adhering to the wiper 44 remains most easily in the gaps on the downstream side of the recording heads 14 in the direction of wiping the ejection surfaces 16, among those between the recording heads 14 and the head holder 20.

Embodiment 2

Figure 6:
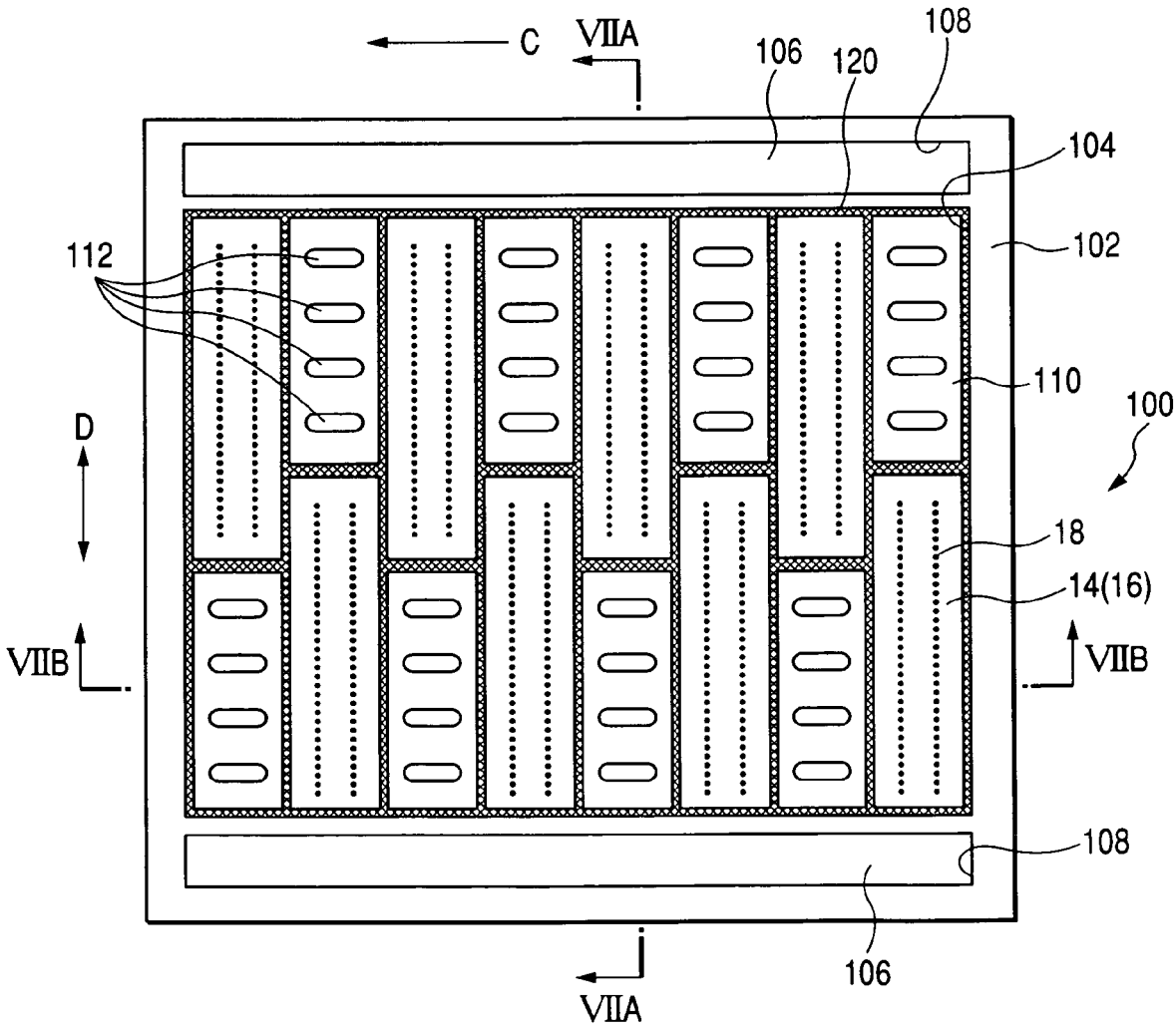
FIG. 6 is a view of an image forming portion 100 in Embodiment 2 as looking from the side of the ejection surfaces 16.
Figure 7A:
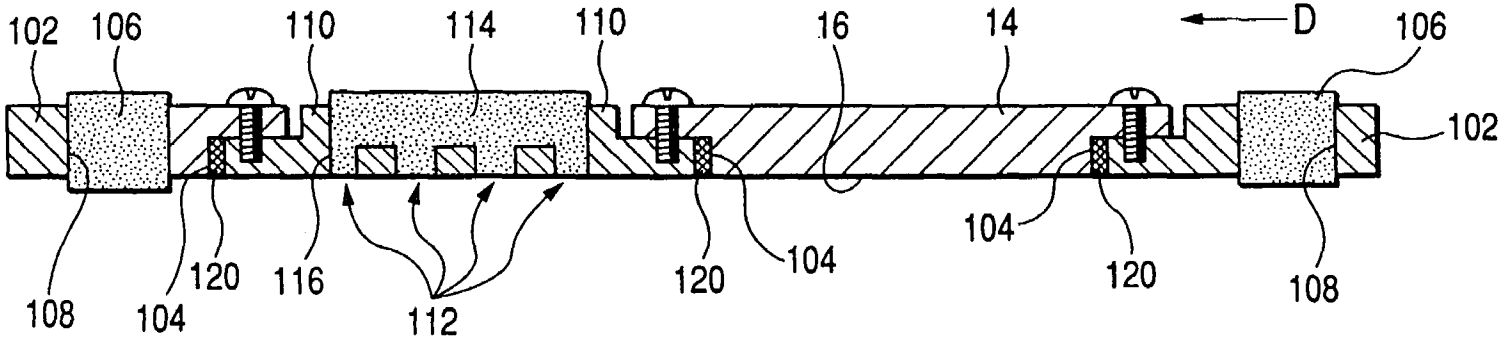
FIG. 7A shows a section view taken along the line VIIA-VIIA in FIG. 6.
Figure 7B:
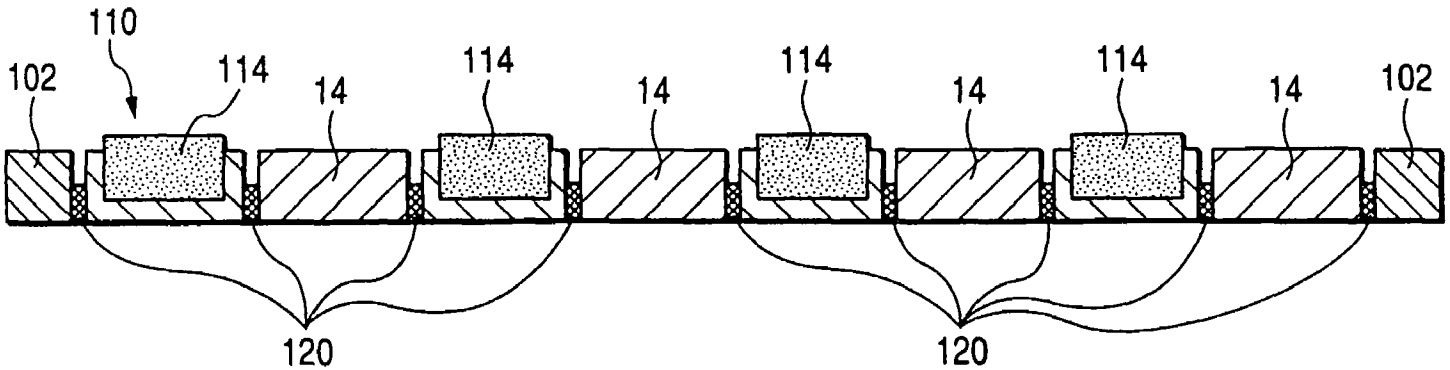
FIG. 7B shows a section view taken along the line VIIB-VIIB

Hereinafter, a second embodiment of the invention will be described with reference to FIGS. 6 and 7. FIG. 6 is a view of an image forming portion 100 in the embodiment 2 when viewed from the ejection surface 16 side. FIG. 7A shows a section view taken along the line VIIA-VIIA in FIG. 6. FIG. 7B shows a section view taken along the line VIIB-VIIB.

In the embodiment 2, the image forming portion 12 of the inkjet printer 10 of the embodiment 1 is replaced with the image forming portion 100, and the other configuration is identical with that of the embodiment 1. In the following description, the components identical with those of the embodiment 1 described above are denoted by the same reference numerals, and their detailed description is often omitted.

As shown in FIG. 6, the image forming portion 100 in the embodiment 2 is configured so that the eight recording heads 14 are attached together with eight spacers 110 to a head holder 102. A fitting opening 104 into which the recording heads 14 and the spacers 110 are to be fitted is defined in the head holder 102. A water repellent process (fluorine coating) is applied to the facing surfaces of the head holder 102 and the spacers 110, which are surfaces facing the medium transport path.

The recording heads 14 are placed so as to partly overlap with one another when viewed in the medium transporting direction (the direction of the arrow C in FIG. 6). The spacers 110 are placed between the recording heads 14.

As shown in FIG. 7A, the recording heads 14 and the spacers 110 are fixed to the head holder 102 with being screw-coupled to one another. The facing surfaces of the spacers 110 are designed so as to be positioned in the same level as the ejection surfaces 16, and have a function of preventing sheet jamming from occurring due to a phenomenon that a sheet transported by the transport unit 30 enters between the recording heads 14.

As shown in FIG. 6, a rubber packing 120, which is an elastic member, is fitted into the gaps between the recording heads 14, the spacers 110, and the head holder 102 so as to prevent ink from flowing into the gaps between the recording heads 14, the spacers 110, and the head holder 102 during the wiping operation to remain therein. A water repellent process (fluorine coating) is applied to the surface of the rubber packing 120, which faces the medium transport path, so as to exert an effect of repelling ink.

As shown in FIGS. 7A and 7B, all of the surface of the rubber packing 120 facing the medium transport path, the ejection surfaces 16 of the recording heads 14, and the facing surfaces of the head holder 102 and the spacers 110 are placed so as to be positioned at the same level (at the same height), or so as not to form a step between them, whereby a phenomenon that ink remains in such a step during the wiping operation is prevented from occurring. When the levels of the ejection surfaces 16, the head holder 102, and the spacers 110 are made different from one another for convenience in the design, the rubber packing 120 is formed and fitted so that one edge of the surface of the rubber packing 120 facing the medium transport path is adjacent to (positioned at the same level as) the ejection surfaces 16, and the other edge is adjacent to (positioned at the same level as) the facing surfaces of the spacers 110 (or the head holder 102). According to the configuration, no step is formed, and hence remaining of ink can be prevented from occurring.

In the maintenance unit 40 of the embodiment 2, the frame 42, the wipers 44, and the comb-like members 46 are disposed so as to correspond respectively to the eight recording heads 14 (this configuration is not shown). In the operation in which the maintenance unit 40 is reciprocally moved in the width direction during the wiping operation between the one and other ends of the head holder 102, among the eight frames 42, those for the recording heads 14, which are on the upstream side of the respective spacers 110 in the movement direction of the maintenance unit 40 (the direction of the arrow D in FIG. 6), are raised so that the wipers 44 disposed on these frames 42 are in contact with the ejection surfaces 16. By contrast, when the maintenance unit 40 is moved in the opposite direction, these frames 42 are lowered so that the wipers 44*a* disposed on these frames 42 are not in contact with the ejection surfaces 16. Namely, the eight frames 42 disposed on the maintenance unit 40 are configured so that, in one of the forward and return paths of one reciprocal movement of the maintenance unit 40, the frames 42 are raised so that the wipers 44 disposed on the frames 42 make contact with the ejection surfaces 16 of the recording heads 14, the facing surfaces of the spacers 110, and a second ink absorbing member 106 which will be described later, in this sequence.

In the head holder 102, as shown in FIG. 6, a placement hole 108 into which the second ink absorbing member 106 (the second ink absorbing member) for absorbing ink adhering to the wipers 44 after the wiping operation is to be fitted is disposed on the downstream side of the respective recording heads 14 in the direction (in the embodiment 2, the directions of the arrow D in FIG. 6) along which the wipers 44 wipe the ejection surfaces 16. The second ink absorbing member 106 is fittingly fixed to the placement hole 108 in such a manner that the lower face of the member slightly protrudes from the facing surface the head holder 102.

As shown in FIG. 6, plural inflow holes 112 are defined in the facing surface of the spacers 110. When the wipers 44 wipe the spacers 110, ink adhering to the wipers 44 flows into the inflow holes 112. The inflow holes 112 are formed into a groove-like shape elongating in a direction perpendicular to the direction (the direction of the arrow D in FIG. 6) along which the wipers 44 wipe the ejection surfaces 16, so that ink of a larger amount can flow into each of the inflow holes 112.

In the side of the spacers 110 opposite to the facing surfaces, as shown in FIGS. 7A and 7B, a first ink absorbing member 114 (functioning as a first ink absorbing member), which absorbs ink, is placed at a position where the first ink absorbing member 114 is in contact with the inflow holes 112 to absorb the ink flowing into the inflow holes 112. In the first ink absorbing member 114, projections 116, which enter the inflow holes 112, project from the lower face thereof. The projections 116 enter the inflow holes 112 to the same level as the facing surfaces of the spacers 110. Since the projections 116 enter the inflow holes 112, it is possible to surely absorb the ink flowing into the inflow holes 112 during the wiping operation. The ink absorbed by the first ink absorbing member 114 is discharged into the waste ink reservoir not shown.

In the case where the projections 116 protrude from the facing surfaces of the spacers 110, when the wipers 44 make contact with the projections 116, the wipers 44 are deformed to be separated from the facing surfaces, thereby causing the possibility that the ink adhering to the wipers 44 still remains on the facing surfaces of the spacers 110. Therefore, the projections 116 preferably enter the inflow holes 112 so long as the projections 116 do not protrude from the facing surfaces of the spacers 110.

In the above-described configuration, when the wipers 44 conducts the wiping operation, the ink adhering to the wipers 44 is blocked from flowing into and remaining in the gaps in the peripheries of the recording heads 14 by the elastic member (rubber packing 120), which can hermetically close the gaps. Since the inflow holes 112 are formed in the spacers 110 and the projections 116 of the first ink absorbing member 114 enter the inflow holes 112, the ink adhering to the wipers 44 can be removed away during the wiping operation, whereby the possibility that the ink remains on the ejection surfaces 16 and the facing surfaces of the spacers 110 can be further reduced.

Although preferred embodiments of the invention have been described above, the invention is not restricted to the embodiments, and can be adequately modified within the technical scope set forth in the claims.

In the embodiment 2, for example, the rubber packing 120 that is an elastic member is used as the inflow preventing member, which prevents ink from flowing into the gaps in the peripheries of the recording heads 14. The material of the inflow preventing member is not limited to rubber, and any kind of member can be used as the member so long as it can hermetically close the gaps and its surface has water repellency. For example, a resin member such as an emulsion adhesive may be poured into the gaps to be cured therein, and a water repellent process may be applied to a surface of the member facing the medium transport path, thereby preventing ink from flowing into the gaps.

Also, a surface of the rubber packing 120 may be recessed from the facing surface of the head holder 20. In this case, the surface of the rubber packing 120 and the facing surface forms steps therebetween. Therefore, the surface of the rubber packing 120 is recessed from the facing surface so long as the steps are formed in so small degree that ink does not remain as a result of the wiping operation.

What is claimed is:

1. An inkjet printer comprising:

a recording head that includes an ejection surface in which a plurality of ejection ports for ejecting ink are defined, wherein the ejection surface faces a medium transport path;

a spacer arranged to fix the recording head and including a facing surface, which faces the medium transport path in the same plane as the ejection surface;

a wiping member that wipes the ejection surface; and an inflow preventing member that prevents the ink from flowing into a gap between the recording head and the spacer, wherein the inflow preventing member includes a water repellent sheet stretched on and bonded to the ejection surface and the facing surface of the spacer without covering the ejection ports.

2. The inkjet printer according to claim 1, wherein the water repellent sheet covers the gap between the recording head and the spacer.

3. The inkjet printer according to claim 1, wherein the water repellent sheet is disposed downstream of the recording head in a direction along which the wiping member is arranged to wipe the ejection surface.

4. The inkjet printer according to claim 1, wherein the water repellent sheet is arranged to cover the entire gap between the recording head and the spacer.

5. The inkjet printer according to claim 1, wherein the water repellent sheet is arranged to cover only a peripheral edge portion of the facing surface.

6. The inkjet printer according to claim 1, wherein the water repellent sheet is arranged to cover the ejection surface and a peripheral edge portion of the facing surface, which is in proximity to the recording head.

7. The inkjet printer according to claim 1, wherein the water repellent sheet is arranged to cover the entire facing surface.

8. The inkjet printer according to claim 1, further comprising:

a first ink absorbent member that absorbs ink and is disposed on a side of the spacer opposite to the facing surface, wherein:

the spacer defines an inflow hole in the facing surface;

the inflow hole communicates between a position where the first ink absorbing member is disposed and the facing surface;

the water repellent sheet includes an opening at position corresponding to the inflow hole of the spacer; and when the wiping member wipes the facing surface, ink adhering to the wiping member flows into the inflow hole.

9. The inkjet printer according to claim 1, further comprising:

a second ink absorbing member arranged to absorb ink adhering to the wiping member and is disposed downstream of the ejection surface in a direction along which the wiping member wipes the ejection surface.

10. The inkjet printer according to claim 1, wherein the ejection surface and the facing surface are at the same height.

11. The inkjet printer according to claim 1, wherein:

the spacer defines an exposure opening through which the ejection surface is exposed; the recording head is fixed to the spacer so that the ejection surface is exposed from the exposure opening; and the inflow preventing member is disposed between the recording head and the exposure opening.

12. The inkjet printer according to claim 11, wherein:

the recording head includes a plurality of recording heads; and the exposure opening includes a plurality of exposure openings so that the plurality of recording heads partially overlap each other when viewed along the medium transport path.

13. The inkjet printer according to claim 1, wherein:

the recording head includes a plurality of recording heads;

the plurality of recording heads are arranged so the recording heads partially overlap each other when viewed along the medium transport path; and the spacer is disposed around and between the plurality of recording heads.

14. An inkjet printer comprising:

a recording head that includes an ejection surface in which a plurality of ejection ports for ejecting ink are defined, wherein the ejection surface faces a medium transport path;

a spacer arranged to fix the recording head and including a facing surface, which faces the medium transport path in the same plane as the ejection surface;

a wiping member that wipes the ejection surface; and an inflow preventing member that prevents the ink from flowing into a gap between the recording head and the spacer, wherein the inflow preventing member closes the gap between the recording head and the spacer.

15. The inkjet printer according to claim 14, wherein the inflow preventing member is disposed in the gap between the recording head and the spacer.

16. The inkjet printer according to claim 14, wherein:

the inflow preventing member blocks the gap between the recording head and the spacer; and the inflow preventing member includes an elastic body having water-repellency and elasticity.

17. The inkjet printer according to claim 16, wherein:

a surface of the inflow preventing member that faces the medium transport path is a flat plane;

one edge of the flat plane of the inflow preventing member is adjacent to the ejection surface; and the other edge is adjacent to the facing surface.

18. The inkjet printer according to claim 14, wherein:

the inflow preventing member includes a resin member that blocks the gap between the recording head and the spacer; and a surface of the resin member that faces the medium transport path has water-repellency.

19. The inkjet printer according to claim 14, wherein the inflow hole is elongate in a direction perpendicular to a direction along which the wiping member wipes the ejection surface.

20. The inkjet printer according to claim 14, wherein the inflow hole includes a plurality of inflow holes.

21. The inkjet printer according to claim 14, wherein the first ink absorbing member is within the inflow hole and is recessed from the facing surface of the spacer.

22. The inkjet printer according to claim 14, wherein:

the first ink absorbing member is within the inflow hole; and a lowermost end of the first ink absorbing member has the same height as the facing surface of the spacer.

23. The inkjet printer according to claim 14, further comprising:

a first ink absorbing member that absorbs ink and is disposed on a side of the spacer opposite to the facing surface, wherein:

the spacer defines an inflow hole in the facing surface;

the inflow hole communicates between a position where the first ink absorbing member is disposed and the facing surface of the spacer;

a part of the first ink absorbing member enters the inflow hole; and when the wiping member wipes the facing surface, ink adhering to the wiping member flows into the inflow hole.

24. The inkjet printer according to claim 14, wherein the recording head includes a plurality of recording heads arranged in a first direction;

the wiping member wipes the ejection surfaces of the plurality of recording heads in a second direction perpendicular to the first direction.

* * * * *